US007338155B2

(12) United States Patent
Niimi

(10) Patent No.: US 7,338,155 B2
(45) Date of Patent: Mar. 4, 2008

(54) PRINTING DEVICE

(75) Inventor: Akiko Niimi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 311 days.

(21) Appl. No.: 10/790,196

(22) Filed: Mar. 2, 2004

(65) Prior Publication Data

US 2004/0179047 A1 Sep. 16, 2004

(30) Foreign Application Priority Data

Mar. 11, 2003 (JP) ..... 2003-065075

(51) Int. Cl.
*B41J 2/01* (2006.01)

(52) U.S. Cl. ..... 347/104; 347/2; 347/4

(58) Field of Classification Search ..... 347/2, 347/101, 102, 103, 104, 171, 4, 5
See application file for complete search history.

(56) References Cited

U.S. PATENT DOCUMENTS 6,095,628 A 8/2000 Rhome ..... 347/4
6,580,444 B1 * 6/2003 Drynkin et al. ..... 347/171
6,760,052 B2 * 7/2004 Cummins et al. ..... 347/171
2002/0140794 A1 10/2002 Asano et al. ..... 347/102

FOREIGN PATENT DOCUMENTS

JP A 9-48135 2/1997
JP 11066703 A * 3/1999
JP A 2000-292614 10/2000

* cited by examiner

*Primary Examiner*—Lam Son Nguyen
(74) *Attorney, Agent, or Firm*—Oliff & Berridge, PLC

(57) ABSTRACT

A printing device, which reduces weight and space while ensuring excellent stability, includes a medium conveyance section on which a workpiece such as a fabric can be set, a fixed side structure for supporting the same, and a head for performing printing onto the workpiece. When the power supply to the device is switched off, the medium conveyance section is at a first position so as to be within the fixed side structure. When a workpiece is set on, or removed from the medium conveyance section, the medium conveyance section is at a second position so as to project partially from one side of the fixed side structure. During a printing operation, the medium conveyance section moves from the second position, to a third position where it projects partially to the second side, and return again to the second position where it projects partially to the second side.

20 Claims, 11 Drawing Sheets

FABRIC SETTING / REMOVING POSITION

PRINTING DEVICE

BACKGROUND OF THE INVENTION

1. Field of the Invention

The present invention relates to a printing device for workpieces such as fabrics, leather, plastic sheets, nonwoven sheets or the like.

2. Description of the Related Art

A fabric printing device as in FIGS. 1, 2 and 3 is disclosed, for example, in U.S. Pat. No. 6,095,628.

This fabric printing device (10) comprises a platen (16) which can move reciprocatingly in the forward and rearward directions of the device (directions indicated by arrow E). Moreover, a configuration is adopted wherein, as illustrated in FIG. 1, a T-shirt (A) is set in position on the platen (16) from the front side of the device, as illustrated in FIG. 2, printing is carried out on the T-shirt (A) on the platen (16) by means of a head (22), and as illustrated in FIG. 3, the T-shirt (A) is removed via the front side of the device.

However, the T-shirt conveyance section (medium conveyance section) including the platen (16) is a relatively heavy object, and if this is positioned to the front side of the device in order to set the T-shirt in position or remove the T-shirt, then an unbalanced state may readily arise in which the device is liable to topple towards the front side.

In particular, when the user lays a T-shirt (A) made from fabric over the platen (16), then in many cases, the user applies a further downward force to the platen (16) which is positioned to the front side of the device, as described above, in order to stretch the T-shirt (A) into a flat state.

In the configuration according to U.S. Pat. No. 6,095,628 described above, in order to prevent the device from toppling forwards, even when a force of this kind is applied thereto, the device is extended significantly in the rearward direction, as illustrated in FIG. 9, in such a manner that the center of gravity thereof is situated towards the rear of the device.

However, this configuration according to U.S. Pat. No. 6,095,628, in addition to increasing the weight of the device, also impedes the possibility of compactification, and causes the cost of the device to increase as well.

Furthermore, in the prior art configuration described above, when the power supply to the device is switched off and the device is not used for a long period of time, dust and dirt can readily accumulate on the platen, thereby causing soiling of the T-shirts, the next time the device is used, and causing operational errors during printing.

SUMMARY OF THE INVENTION

The present invention was devised with the foregoing in view, an object thereof being to provide a printing device which protects the platen from soiling, and the like, and allows weight reduction and compactification of the device as a whole, while maintaining the stability of the device during setting of a workpiece such as fabrics, leather, plastic sheets, nonwoven sheets or the like on the platen (and removal of the workpiece from same) and preventing toppling thereof.

The means for achieving the aforementioned objects of the present invention are described below.

In other words, according to a first aspect of the present invention, provided is a printing device comprising: a medium conveyance section movable reciprocatingly in a linear direction, on which a workpiece can be set in position; a fixed side structure which supports the medium conveyance section and has a space formed therein for accommodating the medium conveyance section; and a head, provided on the fixed side structure, for forming images on the workpiece; wherein the medium conveyance section is positioned so as to be contained within the length of the fixed side structure in the direction of movement of the medium conveyance section, when the power supply to the device is in an off state; the medium conveyance section is positioned so as to project partially to one side from the length of the fixed side structure in the direction of movement of the medium conveyance section, when workpiece is set in position on, or removed from, the medium conveyance section; and during a printing operation onto the workpiece, the medium conveyance section is controlled so as to move from a position where it projects partially to one side from the length of the fixed side structure in the direction of movement of the medium conveyance section, to a position where it projects partially to the other side, and then return again to the position where it projects partially to the one side.

Here, "medium conveyance section" refers to a section which moves together with the workpiece, while maintaining a relative positional relationship with the workpiece, during a printing operation onto the workpiece.

Moreover, here, "fixed side structure" refers to all of the parts of the device apart from the medium conveyance section. The "cover" which is described hereinafter, is not included in the "fixed side structure".

According to a second aspect of the present invention, provided is a printing device comprising: a medium conveyance section movable reciprocatingly in a linear direction, on which a workpiece can be set in position; a fixed side structure which supports the medium conveyance section and has a space formed therein for accommodating the medium conveyance section; and a head, provided on the fixed side structure, for forming images on the workpiece; wherein the medium conveyance section is positioned so as to be contained within the length of the fixed side structure in the direction of movement of the medium conveyance section, when the power supply to the device is in an off state; the medium conveyance section is positioned so as to project partially to one side from the length of the fixed side structure in the direction of movement of the medium conveyance section, when workpiece is set in position on, or removed from, the medium conveyance section; and during a printing operation onto the workpiece, the medium conveyance section is controlled so as to move from a position where it projects partially to one side from the length of the fixed side structure in the direction of movement of the medium conveyance section, towards the other side until the center of gravity thereof passes the center of gravity of the fixed side structure, and then return again to the position where it projects partially to the one side from the length of the fixed side structure.

In a third aspect of the invention, the fixed side structure has a cutaway section for causing the medium conveyance section to be exposed, in the edge on the side to which the medium conveyance section projects when the workpiece is set in position on, or removed from, the medium conveyance section.

In a fourth aspect of the invention, there is also provided a cover for covering the medium conveyance section when it is in a partially projecting state from the fixed side structure, the cover being provided detachably with respect to the fixed side structure.

DESCRIPTION OF THE PREFERRED EMBODIMENTS

An embodiment of the present invention is described below.

Figure 1:
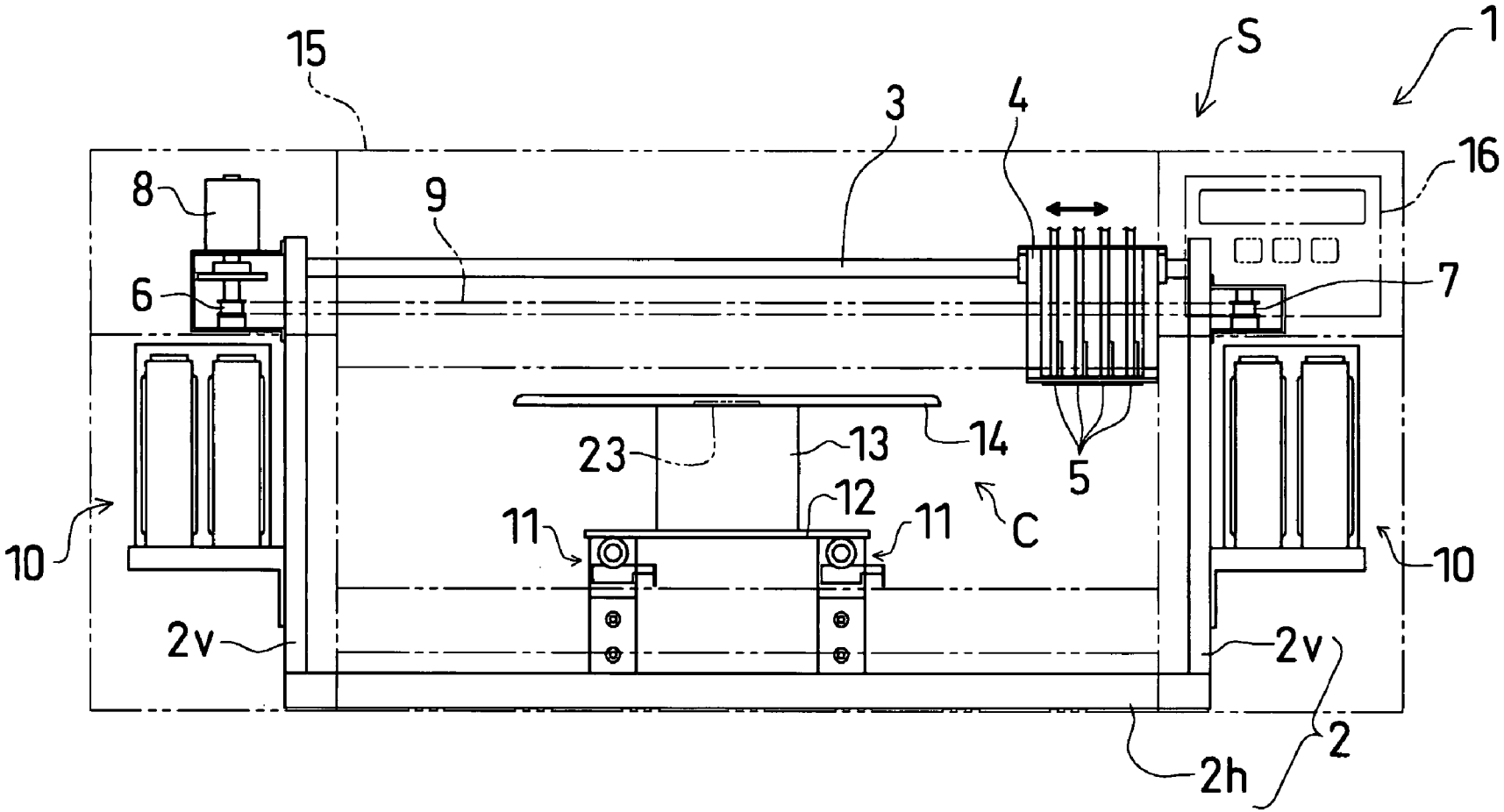
FIG. 1 is a front view showing the overall configuration of a printing device relating to one embodiment of the present invention.
Figure 2:
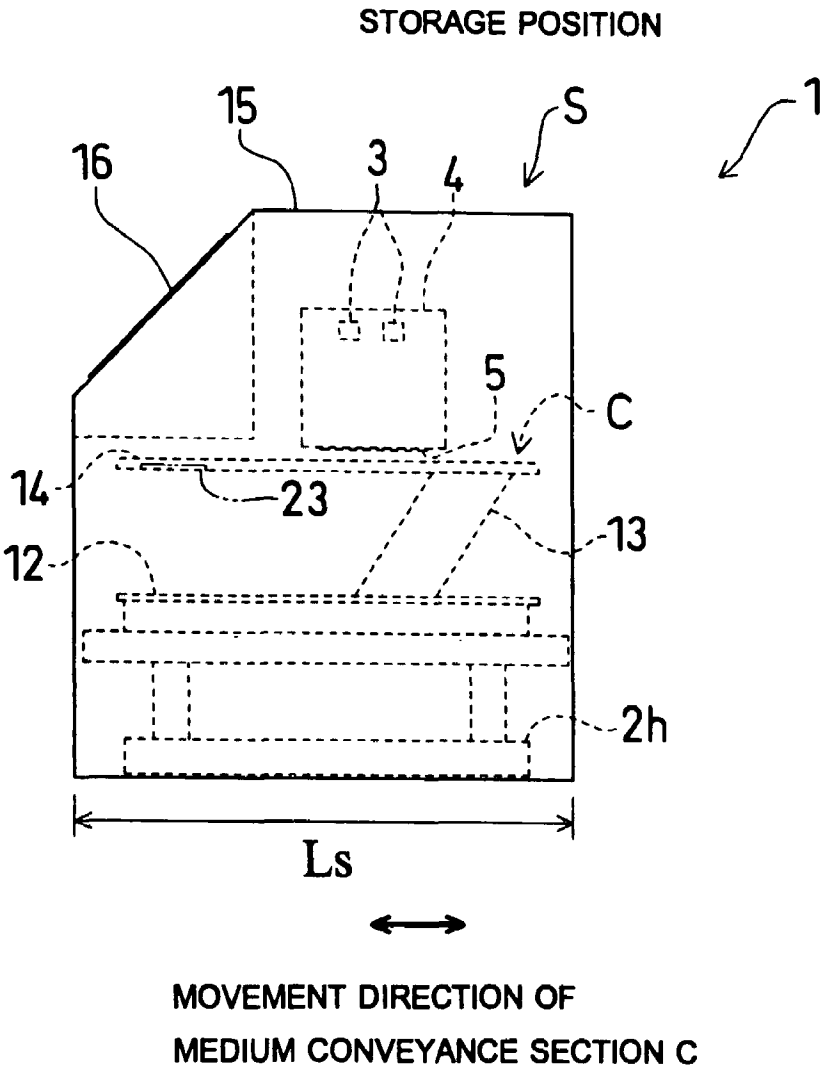
FIG. 2 is a side view of the printing device.

FIG. 1 is a front view showing the overall configuration of a printing device relating to one embodiment of the present invention, and FIG. 2 is a side view of the same.

As shown by the front view in FIG. 1, an ink-jet type printing device 1 is provided with a frame 2. This frame 2 has a horizontal section 2*h* disposed in the lower part of the device, and vertical sections 2*v* which rise up vertically from the respective ends of the horizontal section 2*h*, when viewed from the front side.

A slide rail 3 is suspended horizontally in such a manner that the upper portions of the respective left and right-hand vertical sections 2*v* are mutually connected. A carriage 4 is provided on the slide rail 3, slidably in the longitudinal direction of the rail. A total of four piezoelectric ink-jet heads 5 are provided on the lower face of the carriage 4, one head being disposed for one of four colours (for example, cyan, magenta, yellow or black) in order to eject ink of that colour.

Pulleys 6, 7 are supported respectively on the left and right-hand vertical sections 2*v*, and a motor shaft of a carriage motor 8 supported by the vertical sections 2*v* is coupled to one of the pulleys 6. An endless belt 9 is extended between the pulleys 6, 7, and the carriage 4 is fixed to an appropriate portion of this endless belt 9.

By means of the above configuration, when the pulley 6 is rotated in the forward or backward direction by the drive of the carriage motor 8, the carriage 4 is accordingly driven reciprocatingly in a linear fashion, in the longitudinal direction of the slide rail 3 (main scanning direction), and consequently, the ink-jet head 5 performs reciprocating movement, back and forth.

A mounting section 10 on which an ink tank can be mounted detachably is formed respectively on each of the left and right-hand vertical sections 2*v*. The two mounting sections 10 are each capable of holding ink tanks for two colours, and the ink reservoir formed inside each ink tank is connected to the ink-jet heads 5 by means of a flexible tube (no illustrated).

A slide mechanism 11 is disposed on the horizontal section 2*h* of the frame 2, and a slide base section 12 is supported on this slide mechanism 11. A pillar 13 is provided in a standing fashion on the upper face of the slide base section 12, and a platen 14 is fixed to the upper end of this pillar 13.

A flat work surface is formed on the upper face of this platen 14. In this device, positioning is made such that the section to be printed arrives on the work surface and can be set in a tight and flat state, without creases. The device according to the present embodiment performs ink-jet printing on a T-shirt that has been sewed completedly.

A setting sensor 23 for detecting whether or not a T-shirt has been set in position is disposed on the platen 14.

Moreover, a platen conveyance mechanism is provided in order to move the platen 14 back and forth in a direction perpendicular to the paper surface in FIG. 1 (the sliding direction of the slide mechanism 11, which forms a secondary scanning direction of the printing device). This platen conveyance mechanism is not illustrated in FIG. 1 and FIG. 2, but it is also possible to use a rack and pinion mechanism, or a mechanism based on an endless belt, or the like, as described hereinafter.

Furthermore, a casing 15 is provided in such a manner that it can cover and protect the portion of the endless belt 9 which drives the ink-jet heads 5, and the slide mechanism 11, and the like. In FIG. 1, the casing 15 is depicted in a transparent fashion by the dotted line, in order that the situation inside the casing 15 can be depicted in detail.

An operating panel 16 provided with a liquid crystal display section and operating keys is disposed in a suitable position on the front face of the casing 15.

In the foregoing configuration, the medium conveyance section C referred to in the present invention comprises the aforementioned slide base section 12, pillar 13 and platen 14. Moreover, the fixed side structure S referred to in the present invention comprises the aforementioned frame 2, slide rail 3, carriage 4, ink-jet head 5, pulleys 6, 7, carriage motor 8, endless belt 9, mounting section 10, casing 15, and operating panel 16.

The medium conveyance section C is supported on the fixed side structure S and a space for accommodating the medium conveyance section C is formed inside the fixed side structure S.

Next, a configuration for controlling the printing device 1 is described with reference to FIG. 3.

Figure 3:
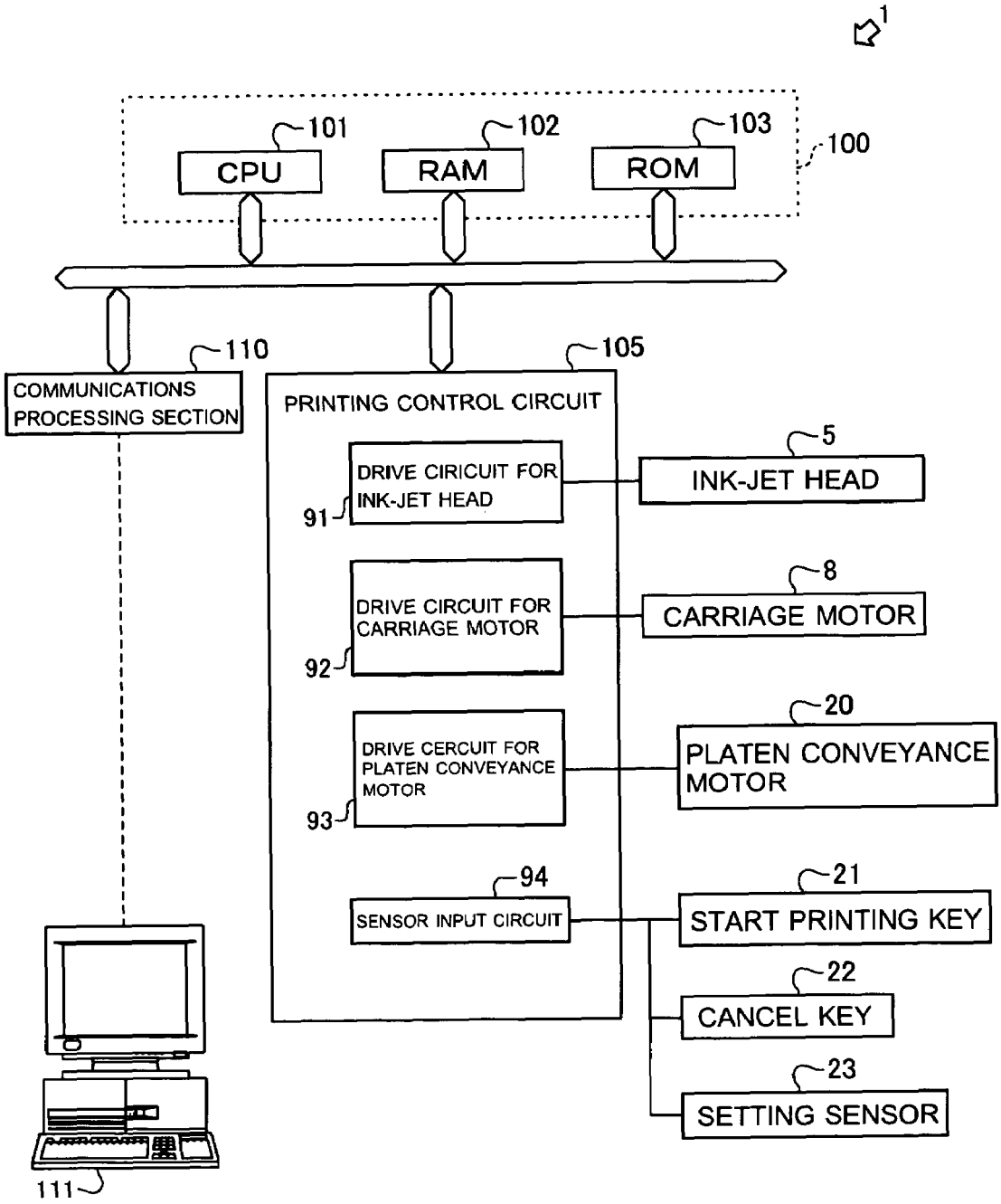
FIG. 3 is a block diagram showing the electrical configuration of the printing device.

FIG. 3 illustrates the electrical configuration of the printing device as a block diagram, and as shown in FIG. 3, a control unit 100 of the printing device 1 comprises a central processing unit (CPU) 101 which performs centralized control of all of the parts of the device 1, a RAM 102 which stores variable data, in a re-writeable fashion, and a ROM 103 which stores fixed data, such as control programs, or the like.

The control unit 100 is connected via suitable data buses, to a printing control circuit 105 and a communications processing section 110.

The printing control circuit 105 contains drive circuits 91 to 93 for driving the ink-jet heads 5, the carriage motor 8 which drives the carriage 4, the motor (platen conveyance motor) 20 of the platen conveyance mechanism which drives the platen 14, and the like. Moreover, the printing control circuit 105 is provided with a sensor input circuit 94, and various types of sensors disposed in the device 1 are connected electrically to this sensor input circuit 94. These sensors include, for example, a "start printing" key 21 provided on the operating panel 16, and a "cancel" key 22 for halting a printing operation, and also the setting sensor 23 disposed on the platen 14, and the like.

The communications processing section 110 is connected via a suitable cable to an upper-level device (in the present embodiment, a personal computer) 111. Hereinafter, references to "personal computer" are abbreviated to "PC". The communications processing section 110 performs the role of an interface, which transfers printing operation commands from the PC 111, to the printing device 1, or sends information regarding the state of the printing device 1, to the PC 111.

By operating the PC 111, a user is able to create and edit image data, by means of an image editing program running on the PC 111. If a printing function is executed in the program, then the PC 111 creates image processing control data to be output for instructing the size of the workpiece such as a fabric, and other image processing information, and this data are sent to the communications processing section 110 of the printing device 1 in the form of printing operation commands. Upon receiving a printing operation command via the communications processing section 110, the control unit 100 interprets and develops the command, and sends a signal to the printing control circuit 105, thereby starting a printing operation, at the timing that the "start printing" key is pressed.

Next, the control sequence in the printing device 1 is described with reference to FIG. 4.

Figure 4:
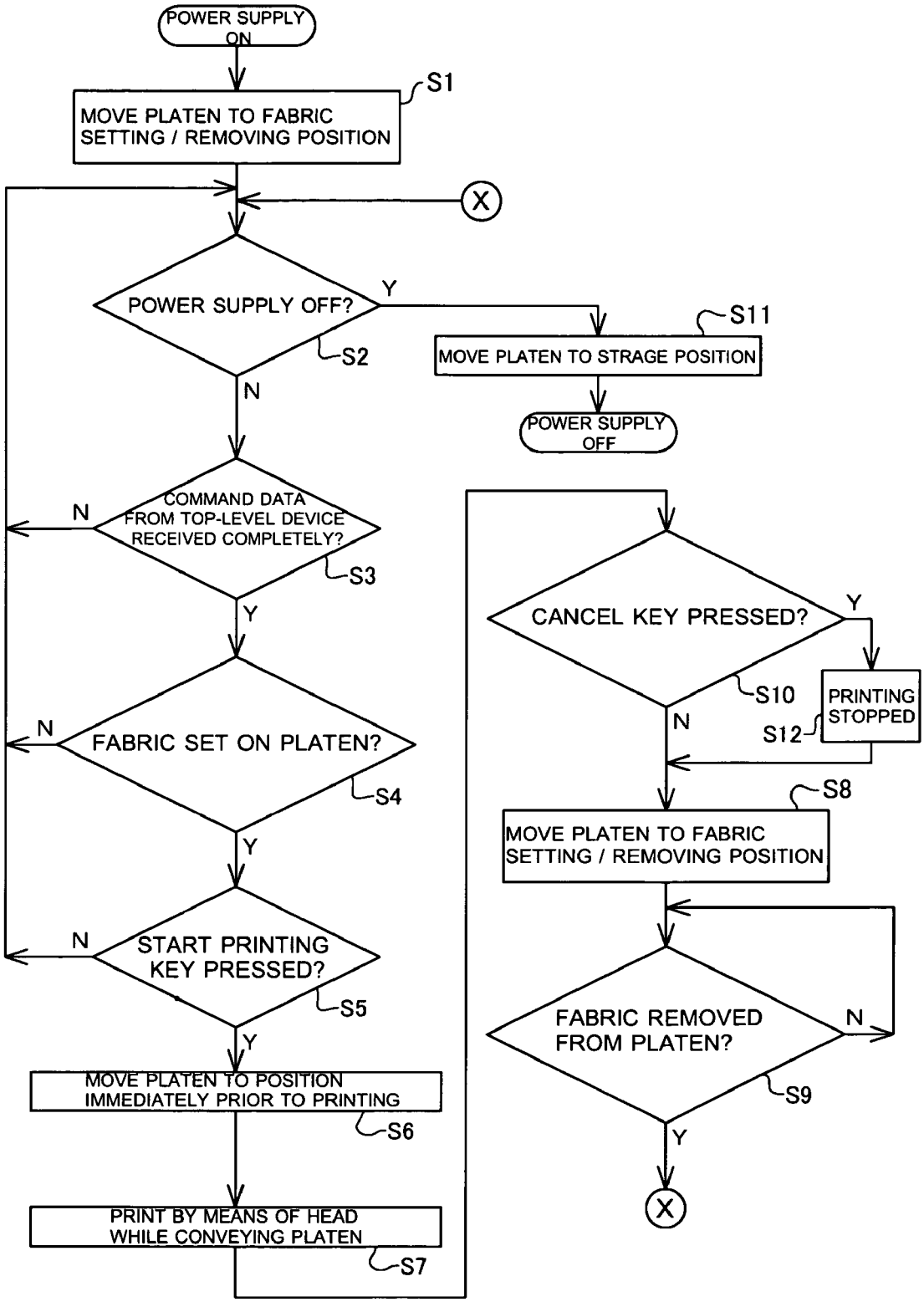
FIG. 4 is a control flow diagram of the printing device.

FIG. 4 is a control flow chart of the printing device.

Figure 5:
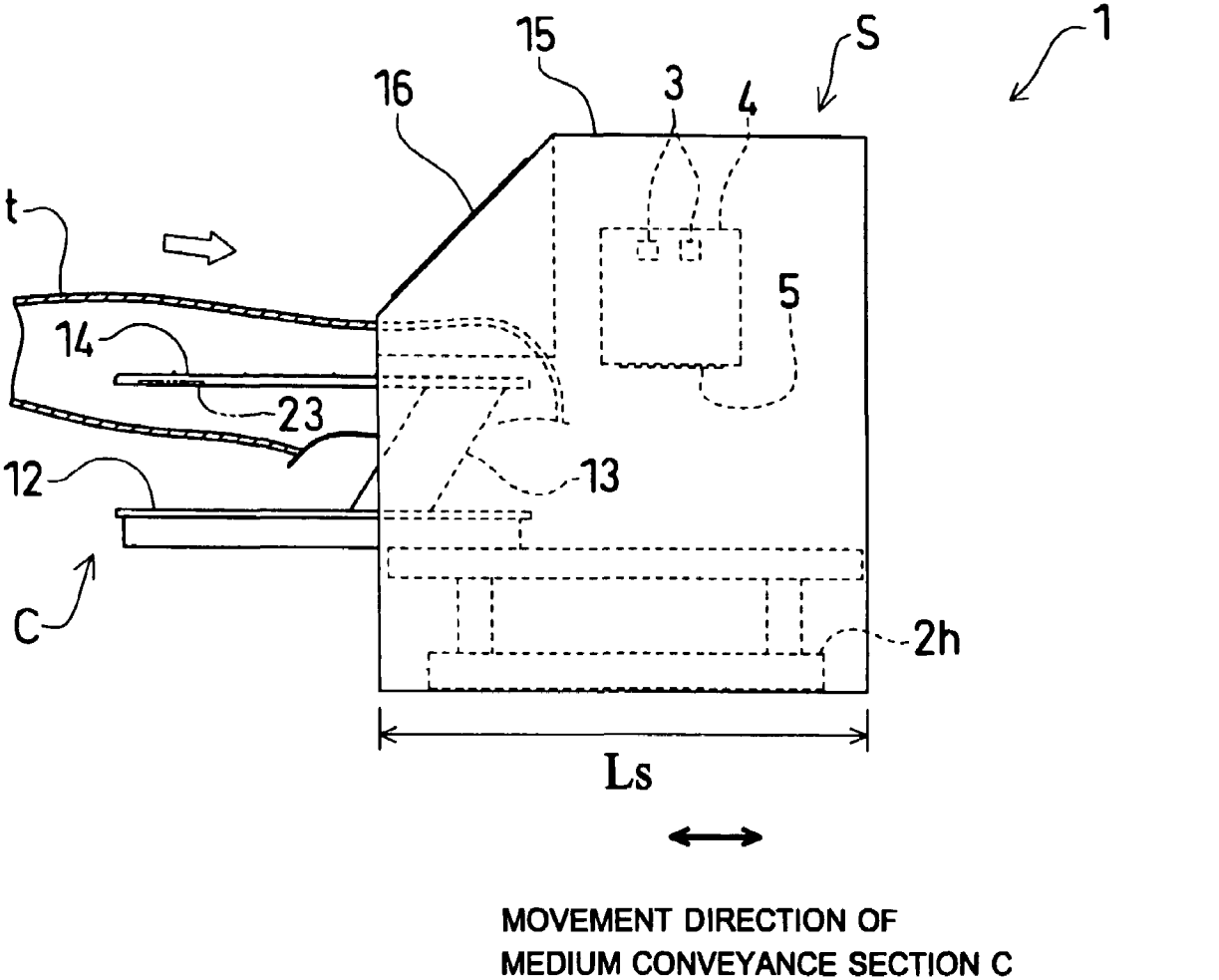
FIG. 5 is a side view showing a state where the medium conveyance section is in a workpiece setting and removing position.
Figure 6:
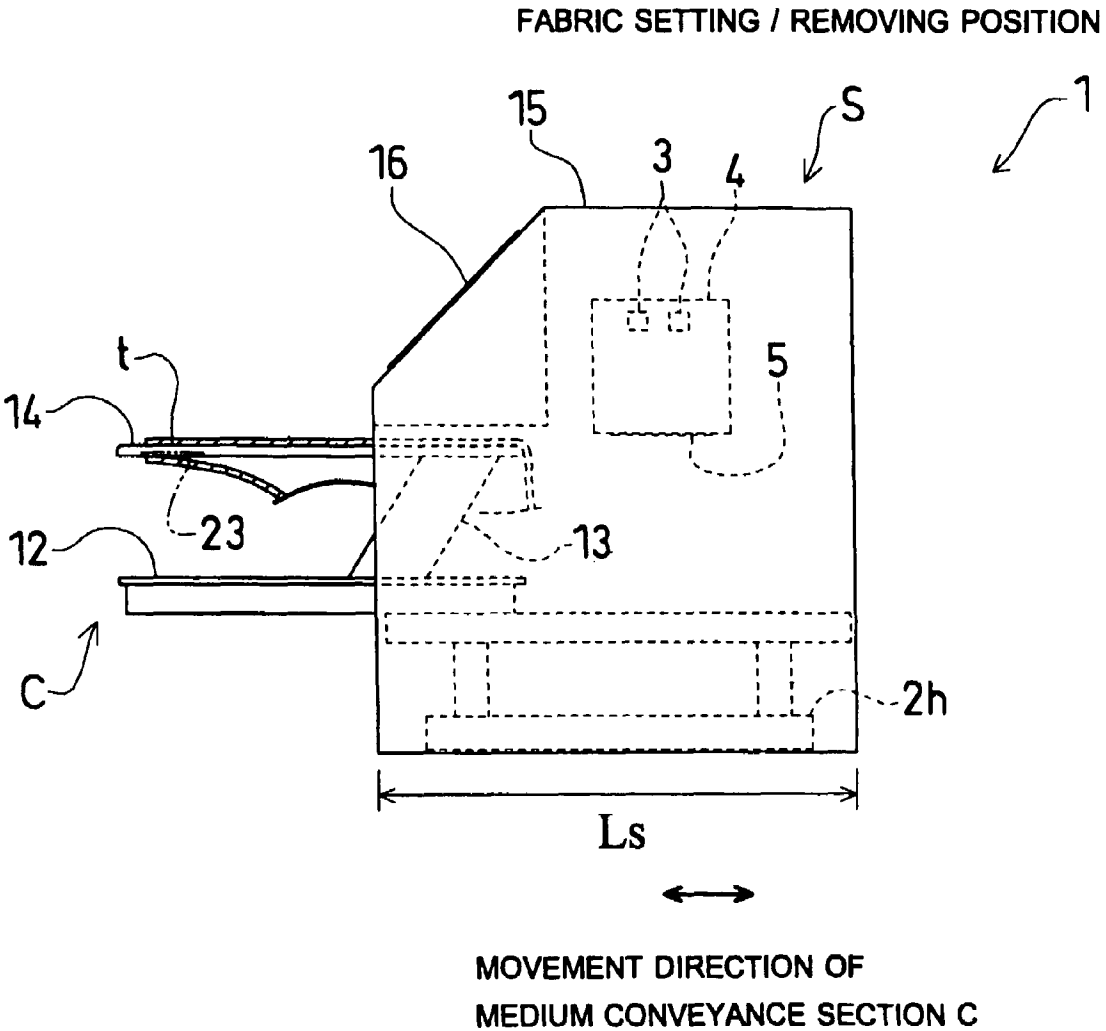
FIG. 6 is a side view showing a state where a T-shirt has been set in position, from the state in FIG. 5.
Figure 7:
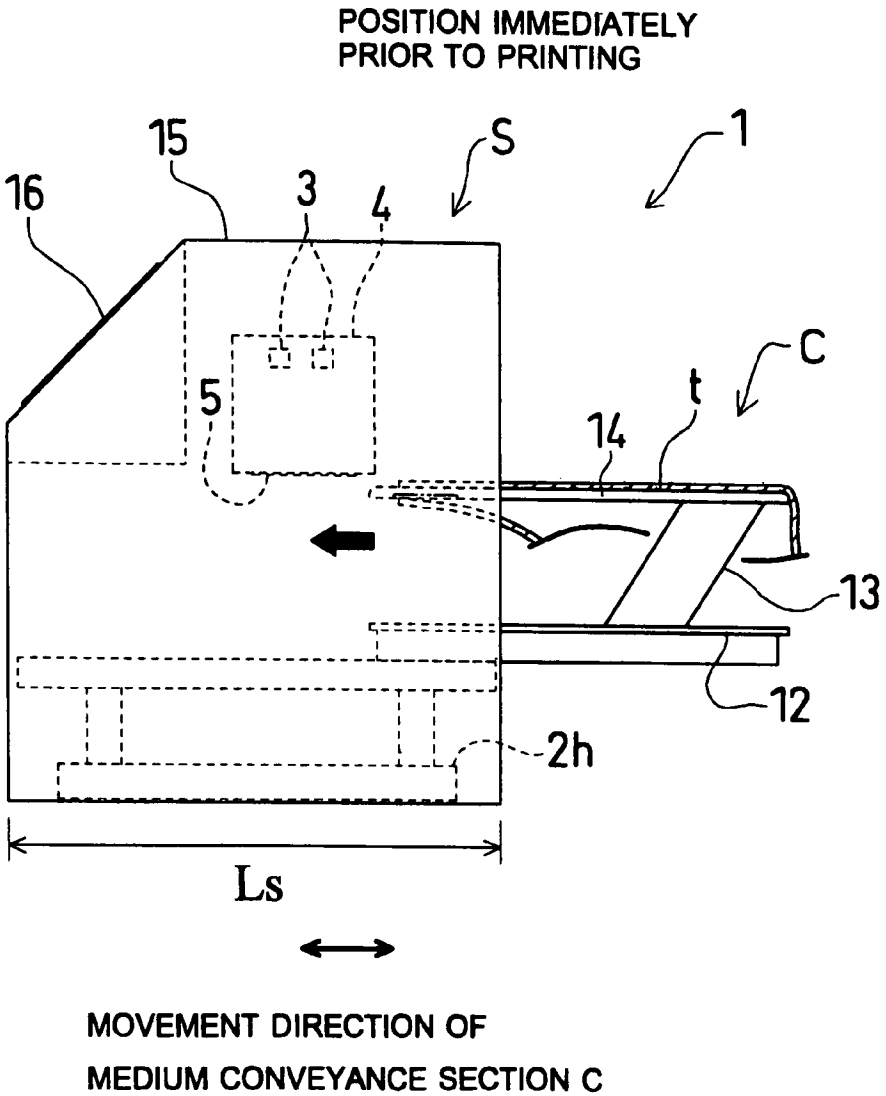
FIG. 7 is a side view showing a state where the medium conveyance section is in a position immediately prior to printing.
Figure 8:
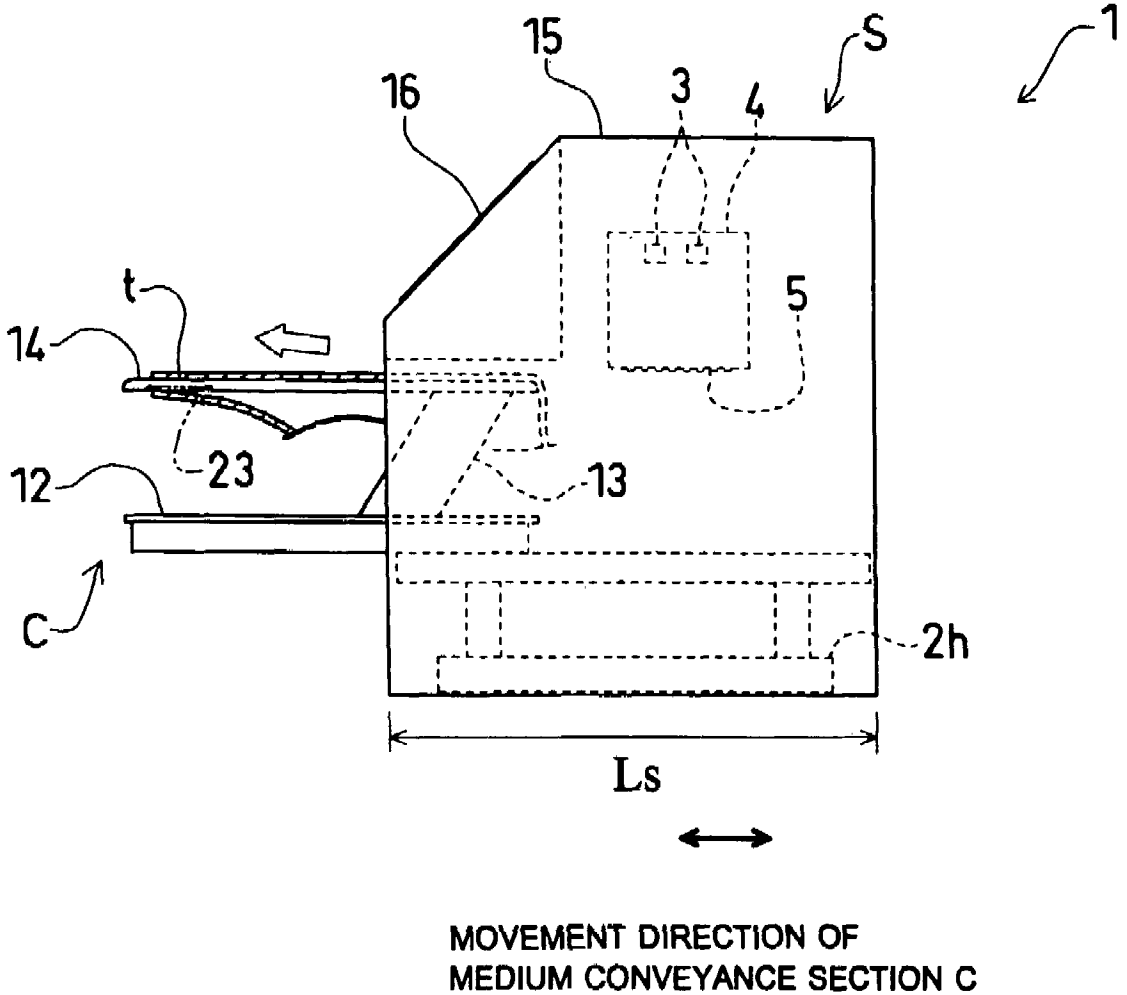
FIG. 8 is a side view showing a state where printing has been completed and the medium conveyance section has returned to the workpiece setting and removing position.

FIG. 5 is a side view showing a state where the medium conveyance section is in a workpiece such as a fabric setting/removing position; FIG. 6 is a side view showing a state where a T-shirt has been set in position, from the state in FIG. 5; FIG. 7 is a side view showing a state where a medium conveyance section is in a position immediately prior to printing; and FIG. 8 is a side view showing a state where printing has been completed and the medium conveyance section has returned to the workpiece setting and removing section.

Figure 9:
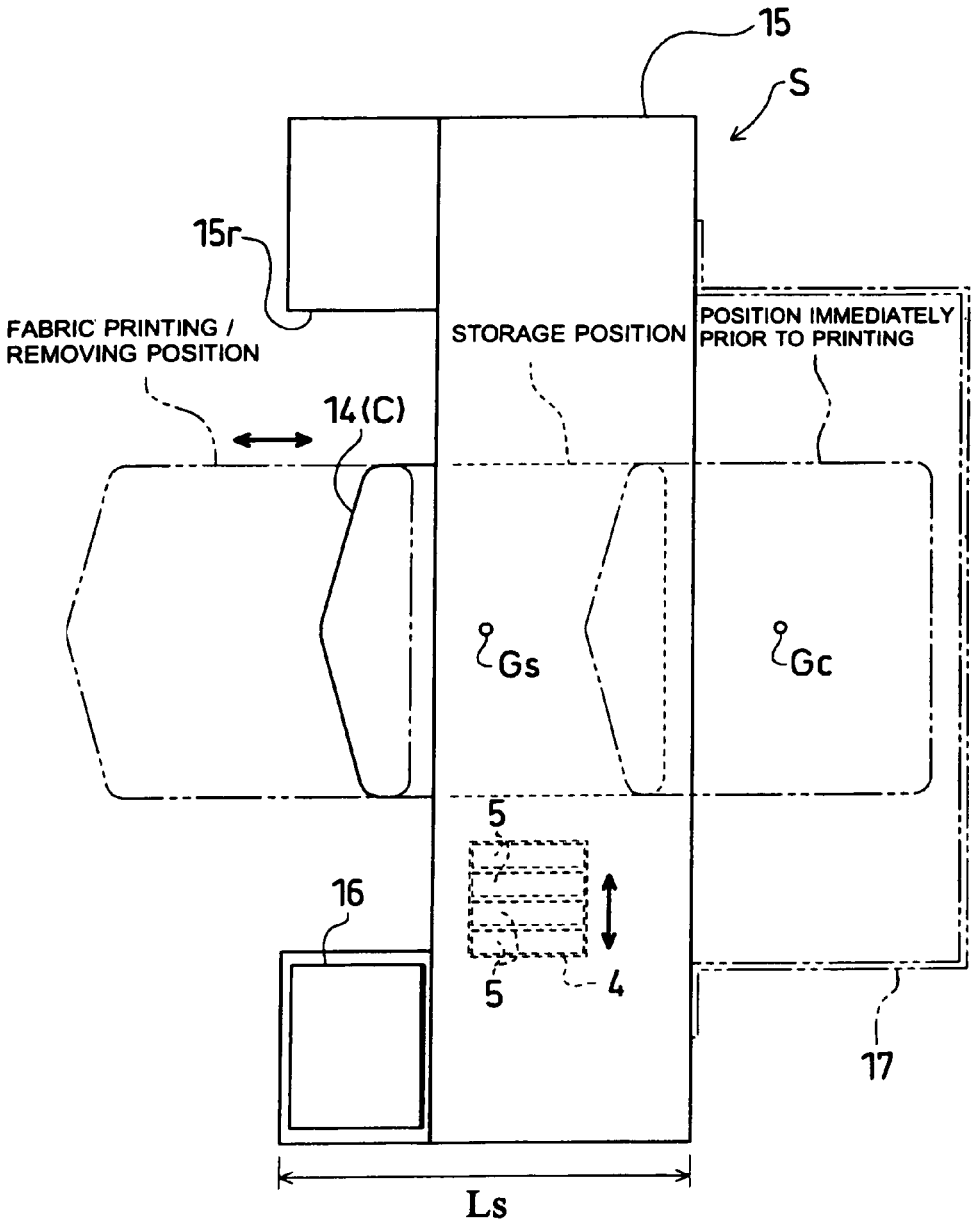
FIG. 9 is an approximate plan view showing the respective positions of the medium conveyance section.

FIG. 9 is a general plan view showing the respective positions of the medium conveyance section.

As shown in FIG. 4, when the power supply is turned on, the CPU 101 performs suitable initialization processing, in addition to which the platen conveyance motor 20 is driven and the medium conveyance section C including the platen 14 is moved to the workpiece setting and removing position (S1).

The "workpiece setting and removing position" referred to here is the position shown in FIG. 5, being a position where the platen 14 projects partially to the front side of the device 1. In other words, this is a position in which the medium conveyance section C projects only partially to one side (in other words, the front side) from the length (Ls) of the fixed side structure S, in the direction of movement of the medium conveyance section C.

Thereby, when the user turns the power switch on, since the platen 14 will be in a projecting state on the front side where the user is situated, the task of setting a T-shirt t in position on the platen 14, as illustrated in FIG. 5, can be completed easily.

Moreover, since the medium conveyance section C only projects partially to one side of the length Ls of the fixed side structure S, when the T-shirt t is being set, then it is not necessary to make the fixed side structure S heavy in weight, or to position the center of gravity of the fixed side structure S on the opposite side to the side on which the medium conveyance section C projects (in other words, the rear side), in order to prevent the device 1 from toppling due to unbalancing during this operation. Consequently, the fixed side structure S (and consequently, the device 1 as a whole) can be made more compact and lighter in weight.

From this state, the user lays a T-shirt t over the platen 14 and sets it in position, as described previously, and, after checking that the print section of the T-shirt t (for example, the chest portion or the back portion) is extended in a non-creased state on the work face of the plate 14, he or she presses the "start printing" key 21 of the operating panel 16.

During the aforementioned operations performed by the user, the CPU 101 performs loop processing from steps S2 to S5. This loop is a standby loop prior to printing, wherein it is determined, in successive fashion, whether or not a power supply off operation of the device 1 has been performed (S2), whether or not reception of print command data from the top-level device (PC 111) has been completed (S3), whether or not setting of a T-shirt t on the platen 14 has been detected by the setting sensor 23 (S4), and whether or not the "start printing" key 21 has been pressed (S5).

The procedure exits this loop in either of two cases: (1) if the power supply has been switched off, or (2) if the data reception from the top-level device has completed, a T-shirt t has been set on the platen 14, and the "start printing" key 21 has been pressed. In any situation other than these two cases, (1) and (2), the loop processing in S2 to S5 is repeated.

If the conditions in (2) above are satisfied, (in other words, if the data reception from the top-level device has completed, if a T-shirt t has been set on the platen 14, and if the "start printing" key 21 has been pressed), then the CPU 101 shifts to the processing in step S6, the platen conveyance motor 20 is driven, and the medium conveyance section C is move to a position immediately prior to printing.

Here, the "position immediately prior to printing" is the position illustrated in FIG. 7, being a position in which the platen 14 projects partially to the rear side of the device 1. In other words, this is a position in which the medium conveyance section C projects only partially to the other side (in other words, the rear side) from the length (Ls) of the fixed side structure S, in the direction of movement of the medium conveyance section C.

After the medium conveyance section C has been positioned in this "position immediately prior to printing", printing by means of the ink-jet heads 5 is started (S7). More specifically, the platen conveyance motor 20 is driven intermittently, and the medium conveyance section C is fed from the position immediately prior to printing, towards the front side of the device 1 (in the direction of the thick black arrow in FIG. 7), by a width of one line at a line, and the carriage motor 8 is driven and caused to scan the carriage 4 back and forth in the main scanning direction, while at the same time, the piezoelectric elements of the ink-jet heads 5 are driven and ink is ejected from the nozzles thereof, thereby printing one line of the image. In this way, the desired image is formed while feeding the T-shirt t towards the front side of the device, together with the medium conveyance section C.

After the printing by the ink-jet heads 5 has been completed, the platen conveyance motor 20 is driven and the medium conveyance section C is caused to move to the workpiece setting and removing position (S8).

Thereby, after printing has completed, as illustrated in FIG. 8, the platen 14 will automatically be in a state where it projects to the front side where the user is situated, and hence the task of removing the T-shirt t from the platen 14 after printing will be easy to carry out.

From this state, the user then removes the T-shirt t from the platen 14. Thereby, the sequence of printing operations ends. Moreover, if a problem of any kind has arise during printing in step S7, and the user has pressed the "cancel" key 22 on the operating panel 16 (S10; Yes), then the printing process is stopped (S12), and the platen is moved to the workpiece setting and removing position (S8). In this manner, the user is able to remove the problem that has occurred.

When it is detected by the setting sensor 23 that the T-shirt t has been removed from the platen 14, after printing has completed (or after the user has completed the task of eliminating the trouble) (S9), then the procedure returns to step S2, and the standby loop processing in steps S2 to S5 is carried out again.

If a power supply off operation is detected during the standby loop processing (steps S2-S5), then the device 1 drives the platen conveyance motor 20 and causes the medium conveyance section C to move from the workpiece setting and removing position, to its storage position, whereupon the power supply is switched off (S11).

The "storage position" referred to here is the position illustrated in FIG. 2, being a position in which the medium conveyance section C is contained within the length (Ls) of the fixed side structure S, in the direction of movement of the medium conveyance section C.

Therefore, the printing device 1 according to the present embodiment has a form whereby at least the major part of the medium conveyance section C is covered by the fixed side structure S, when the power supply is switched off. Consequently, the medium conveyance section C can be protected from soiling or breakage, or the like.

As described above, the printing device 1 according to the present embodiment is controlled in such a manner that (1) the medium conveyance section C is positioned in a "storage position" contained in the length Ls of the fixed side structure S, when the power supply is switched off;

(2) when a T-shirt t is set in position of the medium conveyance section C (platen 14), or removed from same, the medium conveyance section C is positioned in a "workpiece setting and removing position" in which it projects partially to the front side from the length Ls of the fixed side structure S; and (3) in the operation of printing onto the T-shirt t, the medium conveyance section C moves from a position where it projects partially to the front side from the length Ls of the fixed side structure S (the "workpiece setting and removing position" in FIG. 5 and FIG. 6), to a position where it projects partially to the rear side (the "position immediately prior to printing" in FIG. 7), and it then returns again to a position where it projects partially to the front side (the "workpiece setting and removing position" in FIG. 8).

Consequently, as shown in FIG. 9, the length Ls of the fixed side structure S can be set to the minimum length necessary to accommodate the medium conveyance section C. Therefore, the space occupied by the fixed side structure S (and consequently, the size of the printing device 1 as a whole,) can be reduced and the weight thereof can also be reduced.

As illustrated in FIG. 9, in the "position immediately prior to printing" described above, the center of gravity Gc of the medium conveyance section C is positioned to the rear side of the center of gravity Gs of the fixed side structure S.

In other words, in the printing device 1 according to the present embodiment, even if the center of gravity Gs of the fixed side structure S is situated towards the front side in this manner, since the medium conveyance section C only projects partially to the front side of the fixed side structure when in the "workpiece setting and removing position", the device 1 is not liable to topple over forwards, even when the medium conveyance section C is situated in this "workpiece setting and removing position". As a result, the fixed side structure S can be made more compact and can be reduced in weight.

Figure 11:
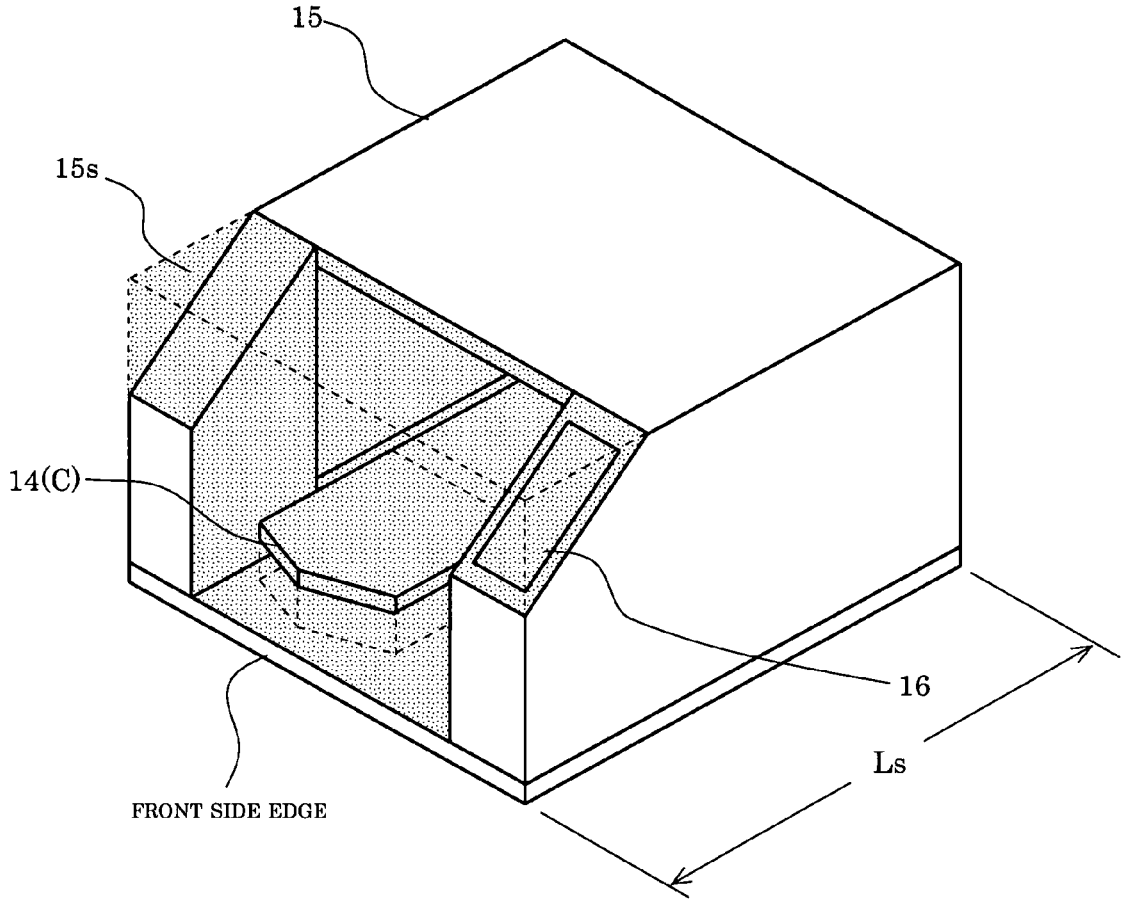
FIG. 11 is a schematic perspective view showing the cutaway section(s) or space(s)

Moreover, as shown in FIG. 9, the fixed side structure S has cutaway sections whereby the medium conveyance section C is exposed, formed in respective edges of the front side (in other words, the side to which the medium conveyance section C projects when in the "workpiece setting and removing position"). More specifically, a cutaway 15*r* is formed in the casing 15 forming part of the fixed side structure S, whereby as in FIG. 11, the cutaway sections 15*s* are formed as dotted spaces.

By incorporating this cutaway section, the exposed surface area of the medium conveyance section C (the exposed surface area of the platen 14) when the medium conveyance section C is positioned in the "workpiece setting and removing position" is increased. Setting and removal of the T-shirt t with respect to the platen 14 can be performed easily, regardless of the fact that the configuration is such that the medium conveyance section C only projects partially from the length Ls of the fixed side structure S, as described previously.

Figure 12:
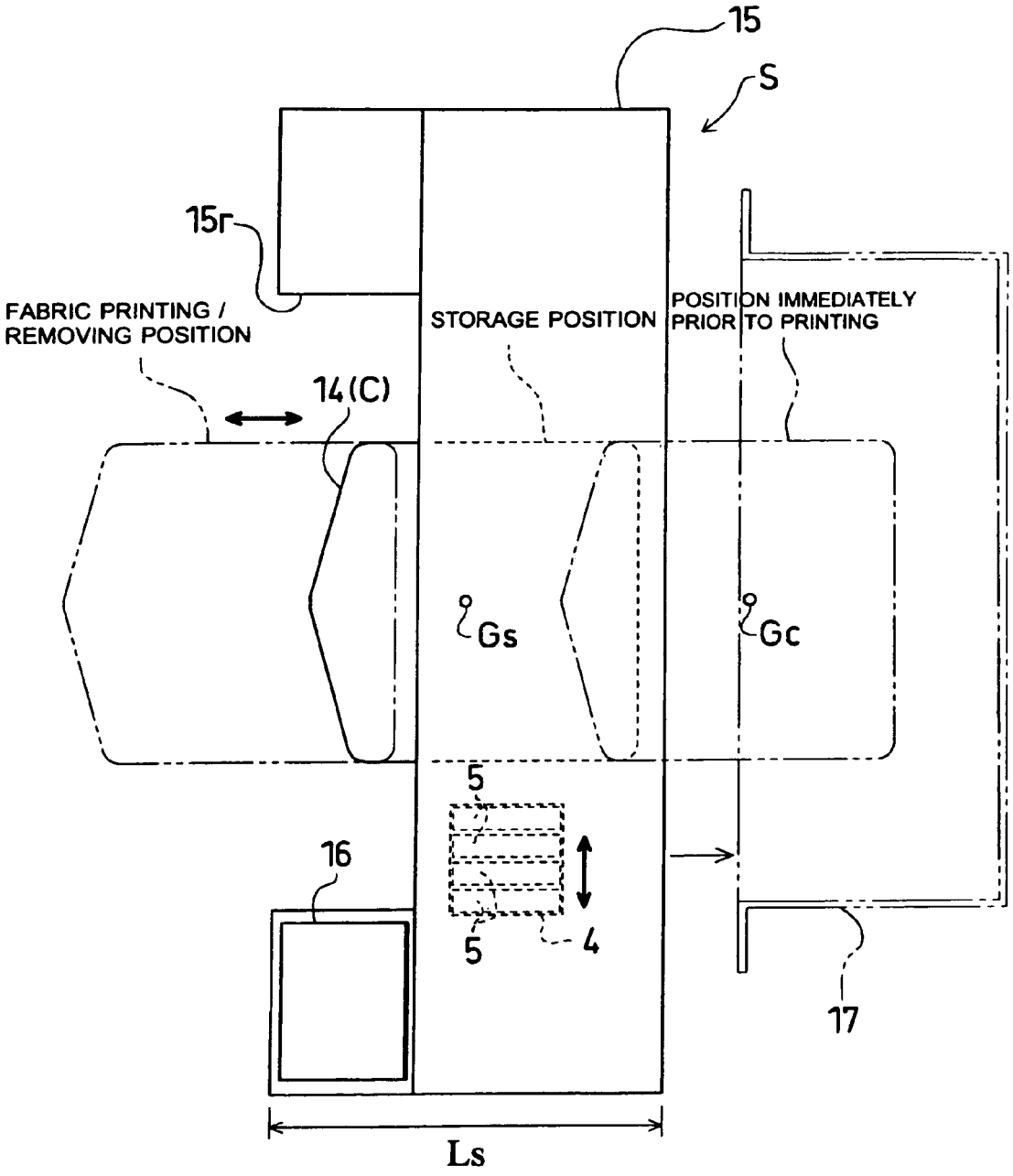
FIG. 12 is an approximate plan view showing the state in which the cover is detached from a casing of the printing device.

As illustrated in FIG. 9, it is also possible to provide a cover 17 detachably on the fixed side structure S, in such a manner that it covers the medium conveyance section C when it is situated in the "position immediately prior to printing". More specifically, FIG. 9 shows that the cover 17 is attached thereon, and FIG. 12 shows that it is detached therefrom.

By incorporating this cover 17, the medium conveyance section C during the printing operation can be protected. On the other hand, the surface area occupied by the device can be reduced by removing the cover 17, when the device is out of use for a long period of time, or during transportation of the device.

Figure 10:
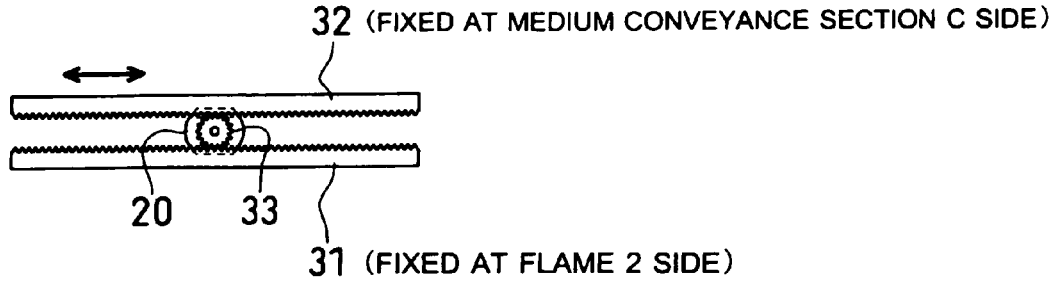
FIG. 10 is a principal part side view showing one example of a drive configuration for a medium conveyance section.

A variety of configurations are conceivable for causing the medium conveyance section C to move between the respective positions describe above, and it is possible to use, for example, a rack and pinion mechanism as illustrated in FIG. 10.

FIG. 10 shows a rack and pinion mechanism which forms one example of a drive mechanism for the medium conveyance section, wherein a first rack 31 is fixed to the horizontal section 2*h* of the frame 2, and a second rack 32 is fixed to the slide base section 12 of the medium conveyance section C, in such a manner that the toothed sections of the respective racks 31, 32 are mutually opposing.

A pinion 33 is situated in such a manner that it is sandwiched between the two racks 31, 32, and this pinion 33 meshes simultaneously with both the first rack 31 and the second rack 32. The motor shaft of the platen conveyance motor 20, which is supported in a horizontally movable fashion on the frame 2, is fixed to the pinion 33.

In this configuration, it is possible to maintain a large movement stroke of the medium conveyance section C, while shortening the length of the first rack 31 on the fixed side (in other words, shortening the length Ls of the fixed side structure S).

Here the rack and pinion mechanism described above is just one example, and the configuration for moving the medium conveyance section C is not limited to that described above.

An embodiment of the present invention was described above, but the technical scope of the present invention is not limited to the configuration described in this embodiment, and various modifications are possible without deviating from the essence of the present invention.

(1) The printing device 1 of the present embodiment is used to print onto a T-shirt, but the present invention is not limited to printing onto T-shirts, and may also be applied to printing onto objects other than T-shirts which may be made of fabric.

(2) The printing device 1 of the present embodiment has a configuration wherein when a printing operation is performed, the medium conveyance section is first moved to a "position immediately prior to printing" on the rear side, and printing is then started by means of the ink-jet heads 5, but the present invention is not limited to this.

In other words, the direction of the feed of the medium conveyance section C when the ink-jet heads 5 are printing can be reversed, and a printing mode can be adopted wherein an image is formed on the T-shirt t by the ink-jet heads 5 while feeding the T-shirt towards the rear side of the device 1, one line width at a time, in such a manner that the medium conveyance section C projects partially to the rear side from the length Ls of the fixed side structure, when printing has almost been completed. In this case also, after the end of printing, the medium conveyance section C is controlled in such a manner that it returns to the aforementioned "workpiece setting and removing position".

(3) In the printing device 1 of the present embodiment, the position of the medium conveyance section C when the workpiece such as a fabric is set in position matches the position of the medium conveyance section C when the workpiece is removed after printing has been completed, but there is no objection to adopting a configuration wherein control is performed such that these positions are not matching.

(4) If a configuration is adopted whereby the center of gravity Gc of the medium conveyance section C is situated to the rear side of the center of gravity Gs of the fixed side structure S, in the "position immediately prior to printing", then it does not matter if the medium conveyance section C does not project to the rear side beyond the length Ls of the fixed side structure S, when in the "position immediately prior to printing". In this case also, reductions in weight and space corresponding to the fixed side structure S are possible.

However, a configuration as in the present embodiment wherein the medium conveyance section C projects to the rear side from the length Ls of the fixed side structure S when in the "position immediately prior to printing" allows the effects of weight reduction and space reduction of the fixed side structure S to be exploited to a greater degree.

(5) The "workpiece setting and removing position" of the medium conveyance section C does not have to be a position wherein it projects to the front side of the device, and a configuration may also be adopted wherein it projects to the rear side of the device, or projects to a lateral side thereof.

(6) The present embodiment relates to an ink-jet type printing device for a workpiece such as a fabric, but the present invention is not limited to this, and may also be applied to a printing device of another printing type.

Having the configuration described above, the present invention has the following beneficial effects.

In other words, since the first aspect of the present invention is a printing device comprising: a medium conveyance section movable reciprocatingly in a linear direction, on which a workpiece such as a fabric can be set in position; a fixed side structure which supports the medium conveyance section and has a space formed therein for accommodating the medium conveyance section; and a head, provided on the fixed side structure, for forming images on the workpiece; wherein the medium conveyance section is positioned so as to be contained within the length of the fixed side structure in the direction of movement of the medium conveyance section, when the power supply to the device is in an off state; the medium conveyance section is positioned so as to project partially to one side from the length of the fixed side structure in the direction of movement of the medium conveyance section, when the workpiece is set in position on, or removed from, the medium conveyance section; and during a printing operation onto the workpiece, the medium conveyance section is controlled so as to move from a position where it projects partially to one side from the length of the fixed side structure in the direction of movement of the medium conveyance section, to a position where it projects partially to the other side, and then return again to the position where it projects partially to the one side. Consequently, a configuration is achieved wherein at least the major part of the medium conveyance section is covered by the fixed side structure when the power supply is switched off, and hence the medium conveyance section can be protected from soiling, damage, and the like.

Since the medium conveyance section only projects partially to one side from the length of the medium conveyance section, when the workpiece is being set in position thereon, or removed therefrom, then it becomes unnecessary to increase the weight of the fixed side structure, and situate the center of gravity of the fixed side structure on the opposite side to the side on which the medium conveyance section projects, in order to prevent toppling of the device due to unbalancing during the setting or removing operation. Accordingly, it is possible to achieve reduction in the space occupied by the fixed side structure (and hence the device as a whole) as well as reduction in the weight thereof.

The present configuration is devised in such a manner that the medium conveyance section projects to the other side from the length of the fixed side structure, during the printing operation, and by adopting this configuration, the beneficial effects of weight reduction and space reduction in the fixed side structure can be exploited satisfactorily.

Since the second aspect of the present invention is a printing device comprising: a medium conveyance section movable reciprocatingly in a linear direction, on which a workpiece such as a fabric can be set in position; a fixed side structure which supports the medium conveyance section and has a space formed therein for accommodating the medium conveyance section; and a head, provided on the fixed side structure, for forming images on the workpiece; wherein the medium conveyance section is positioned so as to be contained within the length of the fixed side structure in the direction of movement of the medium conveyance section, when the power supply to the device is in an off state; the medium conveyance section is positioned so as to project partially to one side from the length of the fixed side structure in the direction of movement of the medium conveyance section, when the workpiece is set in position on, or removed from, the medium conveyance section; and during a printing operation onto the workpiece, the medium conveyance section is controlled so as to move from a position where it projects partially to one side from the length of the fixed side structure in the direction of movement of the medium conveyance section, towards the other side until the center of gravity thereof passes the center of gravity of the fixed side structure, and then return again to the position where it projects partially to the one side from the length of the fixed side structure. Consequently, a configuration is achieved wherein at least the major part of the medium conveyance section is covered by the fixed side structure when the power supply is switched off, and hence the medium conveyance section can be protected from soiling, damage, or the like.

Since the medium conveyance section only projects partially to one side from the length of the medium conveyance section, when the workpiece is being set in position thereon, or removed therefrom, then it becomes unnecessary to increase the weight of the fixed side structure, and situate the center of gravity of the fixed side structure on the opposite side to the side on which the medium conveyance section projects, in order to prevent toppling of the device due to unbalancing during the setting or removing operation. Accordingly, it is possible to achieve reduction in the space occupied by the fixed side structure (and hence the device as a whole) as well as reduction in the weight thereof.

The present configuration is devised in such a manner that, during a printing operation, the center of gravity of the medium conveyance section moves to the aforementioned other side until it passes the center of gravity of the fixed side structure, and by adopting this configuration, the beneficial effects of weight reduction and space reduction in the fixed side structure can be exploited satisfactorily.

In a third aspect of the invention, since the fixed side structure has a cutaway section for causing the medium conveyance section to be exposed, in the edge on the side to which the medium conveyance section projects when the workpiece is set in position on, or removed from, the medium conveyance section, then the surface area of the medium conveyance section that is exposed during setting or removing of the workpiece is increased in accordance with the size of the cutaway section, and hence the operations of setting the workpiece in position and removing the workpiece are facilitated.

In a fourth aspect of the invention, since there is also provided a cover for covering the medium conveyance section when it is in a partially projecting state from the fixed side structure, the cover being provided detachably with respect to the fixed side structure, then it is possible to protect the medium conveyance section with the cover during a printing operation. On the other hand, if the device is to be left out of use for a long period of time, or if it is transported, then the surface area of the space occupied by the device can be reduced by removing the cover.

The entire disclosure of the specification, claims, summary and drawings of Japanese Patent Application No. 2003-65075 filed on Mar. 11, 2003 is hereby incorporated by reference.

What is claimed is:

1. A printing device comprising:

a medium conveyance section movable along a linear direction, on which a workpiece can be set for printing;

a fixed side structure that supports the medium conveyance section and has a covered space formed therein for accommodating the medium conveyance section, the fixed side structure including a first side, a second side, and a length between the first side and the second side, the length being within the covered space, the fixed side structure including a slide rail, the slide rail being within the length of the fixed side structure, the length of the fixed side structure being substantially equal to length of the medium conveyance section; and a head, provided on the fixed side structure, for forming images on the workpiece;

wherein the medium conveyance section moves along the slide rail of the fixed side structure;

wherein the medium conveyance section is at a first position so as to be within the length of the fixed side structure, when a power supply to the device is in an off state;

wherein the medium conveyance section is at a second position so as to project partially from the slide rail from the first side of the fixed side structure, when the workpiece is set on, or removed from, the medium conveyance section; and wherein during a printing operation onto the workpiece, the medium conveyance section is controlled so as to move along the slide rail from the second position where it projects partially from the slide rail from the first side of the fixed side structure to a third position where it projects partially from the slide rail from the second side, and then returns again to the second position where it projects partially from the slide rail from the first side.

2. The printing device according to claim 1, wherein the fixed side structure has a cutaway section for causing the medium conveyance section to be exposed, in an edge on the first side to which the medium conveyance section projects when the workpiece is set in position on, or removed from, the medium conveyance section.

3. The printing device according to claim 2, further comprising a cover for covering the medium conveyance section when it is in a partially projecting state from the fixed side structure, the cover being provided detachably with respect to the fixed side structure.

4. The printing device according to claim 1, further comprising a cover for covering the medium conveyance section when it is in a partially projecting state from the fixed side structure, the cover being provided detachably with respect to the fixed side structure.

5. The printing device according to claim 1, wherein the length between the first side and the second side of the fixed sided structure is longest.

6. The printing device according to claim 1, wherein the medium conveyance section is a platen.

7. The printing device according to claim 1, wherein the workpiece is a fabric.

8. The printing device according to claim 1, wherein the medium conveyance section is controlled so as to move from the second position towards the second side until the center of gravity thereof passes the center of gravity of the fixed side structure, and then return again to the second position.

9. A printing device comprising:

a medium conveyance section movable along a linear direction, on which a workpiece can be set for printing;

a fixed side structure that supports the medium conveyance section and has a covered space formed therein for accommodating the medium conveyance section, the fixed side structure including a first side, a second side, and a length between the first side and the second side, the length being within the covered space, the fixed side structure including a slide rail, the slide rail being within the length of the fixed side structure, the length of the fixed side structure being substantially equal to length of the medium conveyance section; and a head, provided on the fixed side structure, for forming images on the workpiece;

wherein the medium conveyance section moves along the slide rail of the fixed side structure;

wherein the medium conveyance section is at a first position so as to be within the length of the fixed side structure, when the medium conveyance section is accommodated;

wherein the medium conveyance section is at a second position so as to project partially from the slide rail from the first side of the fixed side structure, when the workpiece is set on, or removed from, the medium conveyance section; and wherein during a printing operation onto the workpiece, the medium conveyance section is controlled so as to move along the slide rail from the second position where it projects partially from the slide rail from the first side of the fixed side structure to a third position where it projects partially from the slide rail from the second side, and then returns again to the second position where it projects partially from the slide rail from the first side.

10. The printing device according to claim 9, wherein the fixed side structure has a cutaway section for causing the medium conveyance section to be exposed, in an edge on the first side to which the medium conveyance section projects when the workpiece is set in position on, or removed from, the medium conveyance section.

11. The printing device according to claim 10, further comprising a cover for covering the medium conveyance section when it is in a partially projecting state from the fixed side structure, the cover being provided detachably with respect to the fixed side structure.

12. The printing device according to claim 9, further comprising a cover for covering the medium conveyance section when it is in a partially projecting state from the fixed side structure, the cover being provided detachably with respect to the fixed side structure.

13. The printing device according to claim 9, wherein the length between the first side and the second side of the fixed sided structure is longest.

14. The printing device according to claim 9, wherein the medium conveyance section is a platen.

15. The printing device according to claim 9, wherein the workpiece is a fabric.

16. The printing device according to claim 9, wherein the medium conveyance section is controlled so as to move from the second position towards the second side until the center of gravity thereof passes the center of gravity of the fixed side structure, and then return again to the second position.

17. A printing device comprising:

a medium conveyance section movable along a linear direction, on which a workpiece can be set for printing;

a fixed side structure that supports the medium conveyance section and has a covered space formed therein for accommodating the medium conveyance section, the fixed side structure including a first side, a second side, and a length between the first side and the second side, the length being within the covered space, the fixed side structure including a slide rail, the slide rail being within the length of the fixed side structure, the length of the fixed side structure being substantially equal to length of the medium conveyance section; and a head, provided on the fixed side structure, for forming images on the workpiece;

wherein the medium conveyance section moves along the slide rail of the fixed side structure;

wherein the medium conveyance section is at a first position so as to be within the length of the fixed side structure, when an operating key is selected;

wherein the medium conveyance section is at a second position so as to project partially from the slide rail from the first side of the fixed side structure, when the workpiece is set on, or removed from, the medium conveyance section; and wherein during a printing operation onto the workpiece, the medium conveyance section is controlled so as to move along the slide rail from the second position where it projects partially from the slide rail from the first side of the fixed side structure to a third position where it projects partially from the slide rail from the second side, and then returns again to the second position where it projects partially from the slide rail from the first side.

18. The printing device according to claim 17, wherein the medium conveyance section is a platen.

19. The printing device according to claim 17, wherein the workpiece is a fabric.

20. The printing device according to claim 17, wherein the medium conveyance section is controlled so as to move from the second position towards the second side until the center of gravity thereof passes the center of gravity of the fixed side structure, and then return again to the second position.

* * * * *